US005489199A

United States Patent [19]

Palmer

[11] Patent Number: 5,489,199

[45] Date of Patent: Feb. 6, 1996

[54] BLADE SEALING ARRANGEMENT FOR CONTINUOUS COMBUSTION, POSITIVE DISPLACEMENT, COMBINED CYCLE, PINNED VANE ROTARY COMPRESSOR AND EXPANDER ENGINE SYSTEM

[75] Inventor: William R. Palmer, Melbourne, Fla.

[73] Assignee: Spread Spectrum, Inc., Melbourne, Fla.

[21] Appl. No.: 315,095

[22] Filed: Sep. 29, 1994

Related U.S. Application Data

[63] Continuation-in-part of Ser. No. 940,446, Sep. 4, 1992, Pat. No. 5,427,068.

[51] Int. Cl.[6] ..... F04C 2/00

[52] U.S. Cl. ..... 418/137; 418/241

[58] Field of Search ..... 418/136, 137, 418/235, 241, 259

[56] References Cited

U.S. PATENT DOCUMENTS

| | | | |
|---|---|---|---|
| T930,007 | 1/1975 | Takahashi et al. | 418/137 |
| 3,747,573 | 7/1973 | Foster | 418/137 |
| 4,168,941 | 9/1979 | Rettew | 418/137 |
| 4,451,218 | 5/1984 | Rembold | 418/137 |

FOREIGN PATENT DOCUMENTS

| | | | |
|---|---|---|---|
| 4524513 | 2/1967 | Japan | 418/259 |
| 1382603 | 2/1975 | United Kingdom | 123/204 |

*Primary Examiner*—Charles Freay
*Attorney, Agent, or Firm*—Charles E. Wands

[57] ABSTRACT

A pinned vane type, positive displacement, rotary device includes a tangentially translatable roller arrangement for sealing each of a plurality of rotatable blades that are pivotally attached to an inner hub and extend through blade spreader elements of an outer hub assembly to contact the interior surface of the device. Each of roller elements on either side of a respective blade is allowed to rotate about its own axis, while the unloaded one of the roller elements is allowed to translate tangentially relative to a circular path described by the outer hub assembly. The sealing arrangement accommodates pivoting of the blade about an axis that passes through the blade in the radial direction from the inner hub to the interior surface of the housing, so that the contact surface between each roller element and its associated blade has no gaps across the surface of the blade between outer hub assemblies. The sealing arrangement also includes sealing elements biased against the rollers preventing gas leakage during translation motion of the unloaded roller element.

18 Claims, 8 Drawing Sheets

BLADE SEALING ARRANGEMENT FOR CONTINUOUS COMBUSTION, POSITIVE DISPLACEMENT, COMBINED CYCLE, PINNED VANE ROTARY COMPRESSOR AND EXPANDER ENGINE SYSTEM

CROSS-REFERENCE TO RELATED APPLICATIONS

The present application is a continuation-in-part of my co-pending application Ser. No. 940,446 (hereinafter referenced as the '466 application), filed Sep. 4, 1992, entitled: "Rotary Compressor and Engine System," assigned to the assignee of the present application, and the disclosure of which is incorporated herein. It also relates to the subject matter of a new and improved continuous combustion, pinned vane type, positive displacement, rotary compressor and expander engine system, described in my co-pending application entitled: "Method and Apparatus for Transferring Heat Energy from Engine Housing to Expansion Fluid Employed in Continuous Combustion, Pinned Vane Type, Positive Displacement, Integrated Rotary Compressor-Expander Engine System, Increasing Energy Density of Expansion Fluid," Ser. No. 08/315,103 filed coincident herewith, (hereinafter referred to as the '103 application assigned to the assignee of the present application, and the disclosure of which is also incorporated herein.

FIELD OF THE INVENTION

The present invention relates in general to rotary machines and, more particularly, to a tangentially translatable roller arrangement for sealing each of a plurality of rotatable blades that are pivotally attached to an inner hub and extend through blade spreader elements of an outer hub assembly to contact the interior housing surface of a continuous combustion, pinned vane type, positive displacement, rotary compressor and expander engine system.

BACKGROUND OF THE INVENTION

FIGS. 1, 1A, 2 and 3 diagrammatically illustrate the configuration of a continuous combustion, positive displacement, pinned vane compressor and expander heat engine system, of the type described in each of the above-referenced applications, in which each of the compressor and the expander portions of the engine system employ substantially the same rotary device structure and are integrated together in a compact system architecture.

In particular, as shown in the sectional view of FIG. 1, the basic configuration of the rotary device comprises a housing 11 containing an inner hub 13 and an outer hub assembly 15. The inner hub 13 rotates about a central first axis 21 of an interior chamber 23 of the housing 11, while the outer hub assembly 15 rotates about a second axis 25 that is offset from the central first axis 21. The inner hub 13 is located within the outer hub assembly 15, and is mechanically linked with the outer hub assembly 15 by way of a timing gear arrangement 26 and 28, an end sectional view of which is shown in FIG. 1A.

A plurality of vanes or blades 31 are pivotally attached or pinned through respective axes 38 passing through one end of each of the blades 31 at the inner hub 13, so that the blades 31 may rotate about these respective axes 38, as shown by arrow 39. The blades or vanes 31 pass through slots 35 between blade spreader elements 36 of the outer hub assembly 15. The blade spreader elements are supported by and ride on a pair of parallel ring members 17 of the outer hub assembly 15 by means of roller elements 16. An individual ring member 17 is shown in FIG. 1, while the cut-away view of FIG. 3 shows respective pairs of ring members for each of the expander and compressor sub-systems of the engine. Within the outer hub assembly 15, each blade spreader element 36 encapsulates roller elements 16 which engage the blades 31 at different locations and thereby different angles, because of the offset location of the inner hub 13 relative to the axis 25 of the outer hub assembly 15.

A respective blade 31 has a first radially interior portion 32, which engages the inner hub 13, and a second, radially outer portion which passes between spreader elements of the outer hub assembly 15 to the interior surface 12 of the housing 11. Rotation of the inner hub 13 about the first central axis 21 causes the interior portion 32 of each blade 31 to be driven or rotate about the central axis 21. In an expander application, high pressure working fluid gas from the inlet to the housing 11 applies a force on the outer portion 34 of each blade 31. The force on the blade outer portion 34 is transferred to the outer hub assembly 15 by means of the roller elements 16 contained in the spreader elements 36 on the ring members 17. The force on the roller elements 16 against the spreader elements 36 thereby drives the outer hub assembly 15 about the second axis 25. (In a compressor application, working fluid gas from the inlet to the housing 11 is compressed by driving the outer hub assembly, so that the outer hub assembly 15 applies a force on the blades by means of the roller elements 16. Rotation of the blades serves to compress the working gas.)

The gearing linkage 26, 28 between the inner hub 13 and the outer hub assembly 15 is such that, as the blades 31 rotate during rotation of the inner hub about the first axis and the outer hub assembly about the second axis, the blades 31 depart from extending radially about the first axis 21. This departure of the blades 31 from the radial direction forms a plurality of relatively airtight compartments 37 between the interior surface 12 of the housing 11, the outer hub assembly 15, and respective pairs of blades 31. The volume of the compartments 37 varies as a function of rotative position around the first central axis 21, so that the rotary device may be employed as either a compressor device or an expander device.

As diagrammatically illustrated in FIG. 2, in a combined engine system, both a compressor 41 and an expander 43 are employed in combination with a combustor 45. In the compressor 41 of the engine system, the input shaft 42, to which the inner hub of the compressor is connected, is driven. This driving of the compressor's inner hub causes its outer hub assembly to be rotated by the gearing linkage between the two, so that the blades are rotated to compress a combustion gas (e.g. air) which is applied to a compression gas inlet, shown at 46. The compressed gas is then supplied to a compressed gas outlet port 48 for application to an air inlet port 51 of a downstream continuous combustion system 45. A combustible fuel is supplied to a fuel inlet port 53 of combustor 45, where it is mixed with the compressed air and ignited. The combusted gas is then ported via outlet port 55 as an expandable working gas to the inlet port 57 of the expander 43. The combusted working fluid may be augmented by the introduction of steam to realize an expandable working gas mixture of steam and combusted gas.

In the expander 43 of the engine system, the expandable gas from the upstream combustor 45 that has been applied to inlet port 57 of the expander housing pushes against the expander's rotary blades which, in turn, push upon the outer hub assembly of the expander 43, causing the expander's outer hub assembly to rotate. As the outer hub assembly of the expander 43 rotates, the gearing arrangement between the outer hub and the expander's inner hub causes the inner hub to rotate, so that the blades travel rotationally around the interior of the expander housing. Then, as the expander blades rotate, successive compartments of the expander containing the working gas increase in volume and thereby allow the gas to expand, and eventually exit an exhaust port 56. During rotation of the expander's outer hub assembly and, consequently, its mutually geared inner hub, rotation of the inner hub drives an output shaft 58, producing work out for driving a load. The work output shaft 58 of the expander 43 may be an extension of the work input shaft 42 of the compressor 41. Also, the outer hub assembly of the expander may be an extension of the compressor's outer hub assembly, thereby forming a continuous system requiring only one set of timing gears.

As described in the above-referenced related '103 application entitled "Method and Apparatus for Transferring Heat Energy from Engine Housing to Expansion Fluid Employed in Continuous Combustion, Pinned Vane Type, Positive Displacement, Integrated Rotary Compressor-Expander Engine System, Increasing Energy Density of Expansion Fluid," filed coincident herewith, and as shown in the partially cut-away perspective view of FIG. 3, the architecture of such an engine system is formed as an integrated unit, in which the fundamental rotary device architecture of each of the compressor and an expansion fluid sub-system-augmented expander of the engine essentially corresponds to that of the rotary device, described above. The compressor and the expansion fluid-augmented expander share a common rotating shaft. A combustor is interposed between the compressor and the expander of the engine system. Also the starter/ generator and a timing gear assembly are housed in an integrated assembly with the compressor, combustor and expander.

In accordance with engine system operation, the compressor portion of the engine takes in fresh air, compresses that air and supplies the compressed air to the engine's combustor. In the combustor, this compressed air is then mixed with a combustible fluid, combusted, and output as an expandable working gas to the expander, wherein the working gas is expanded and used to perform work and rotate the engine output shaft.

During the rotational process carried out by each of the engine's rotary device structures (compressor and expander), blade articulations are required as a blade 31 passes back and forth through the spreader elements 36 of the outer hub assembly 15. As described above, roller elements 16 are operative to transfer forces between outer portions of the blades 31 and the outer hub assembly 15. Namely, in the expander device, the force on the roller elements 16 by rotation of the blades 31 during expansion of the working gas in the expander compartments drives the outer hub assembly 15 about the second axis 25. Conversely, in the compressor device, rotation of the outer hub assembly 15 imparts a force on the blades 31 through the roller elements 16 that are supported by and ride with the parallel ring members 17 of the outer hub assembly 15.

For proper operation, it is necessary that each of the compression/expansion compartments be continuously sealed. Specifically, since each compartment includes interfaces between a spaced apart pair of roller elements 16 and respective blades 31 engaging those roller elements, it is necessary that these roller element—blade interfaces be sealed. Such a sealing mechanism must allow for mutual translation between a blade 31 and the roller elements 16 on either side of the blade as the blade rotates about it pinned axis 38 at the inner hub 13; it must also allow for rotation of the blade 31 about an axis along the blade center line that extends in the radial direction from the inner hub to the interior surface of the housing, in order that each blade 31 may remain parallel to and in contact with the entire length of its associated roller elements 16, so that there is no gap between the opposite surfaces of the blade 31 and the roller elements.

SUMMARY OF THE INVENTION

In accordance with the present invention, this sealing requirement is successfully addressed by allowing each of the roller elements on either side of the blade to rotate about its own longitudinal axis, on the one hand, and to allow one of these roller elements (specifically, the unloaded roller element) to also tangentially translate along a circular path described by the outer hub assembly. To this end, pursuant to the improvement provided by the present invention, first and second ends of each of the spreader elements has respective slots assemblies, each of which is sized to receive a respective one of the generally cylindrically configured roller elements, so that the roller elements may rotate freely about their longitudinal axes and thereby accommodate changes in orientation of the blades during their rotation about the inner hub. Opposite ends of a respective roller element are captured in respective needle bearing races of a pair of spaced apart outer hub assembly ring members, between which the spreader elements, roller elements and blades rotate.

As noted above, that one of a spreader element's slot assembly that receives an unloaded roller element is shaped to allow for translation of the non load bearing roller element towards and away from the blade with which it is engaged. By non-loaded is meant the roller that is not in the main load path between the blade and the roller performing the work. There is, however, a lesser amount of load on the roller which is provided by spring elements for the purposes of providing sealing engagement.

The un-loaded roller element is allowed to translate in a slot which is somewhat deeper than the slot provided for the loaded roller element. The slots for the roller element are provided in adjacent ends of each spreader element. The spreader elements do not translate any load but provide for sealing of the roller elements, one of which is stationary and one of which is tangentially translatable along the circular profile of the outer hub assembly.

This ability to translate the unloaded roller element in the slots of the spreader provides a limited amount of play between the unloaded roller element and the surface of an associated blade, so that as the inner hub, blades and outer hub assemblies rotate during a working cycle, the unloaded roller element is allowed to shift relative to the engaged surface of the blade.

In order to maintain the unloaded roller element in sealed engagement with the blade surface, the parallel ring elements further include channels, which contain a compression spring at each end of the unloaded roller elements. The compression springs serve to bias the unloaded roller element toward its associated blade regardless of the rotational position of the blade about the inner hub, thus maintaining the outer cylindrical surface of the unloaded roller element in continuous contact with the blade.

In the expander, where the expanding gas causes rotational movement of the blades, their loaded downstream surfaces are urged directly against loaded roller elements.

Since the needle bearing assemblies of these loaded roller elements allow for only rotation, but do not provide for translation, of their captured roller elements, the pressure of the expansion gas against each blade surface is imparted directly through the blades and loaded roller elements to the parallel ring elements containing the needle bearings of the outer hub assembly, causing the outer hub assembly to rotate in the direction of working gas expansion. At the same time, since the unloaded roller elements on the upstream sides of the blades are biased by compression springs acting against moveable needle bearing assemblies at the ends of the unloaded roller elements and interfacing the high pressure side of the blade surfaces, the unloaded roller elements are maintained in continuous sealing engagement with the blade surfaces.

In the compressor configuration, the unloaded slot assemblies are located downstream of the direction of travel whereas the loaded needle bearing and roller assemblies are located on the upstream side of each blade. As the outer hub assembly is driven, the needle bearing elements containing the ends of the loaded roller of the outer hub assembly urge the loaded roller elements directly against the upstream surfaces of the blades, causing the blades to rotate and thereby compress the gas in the working fluid compartments. On the other hand, since the unloaded slot assemblies provide translation of their captured roller elements on the downstream surfaces of the blades, the compression springs maintain the roller elements in continuous sealing engagement with the blade surfaces.

The roller elements are end-terminated in parallel, spaced apart ring members of the outer hub assembly. A first end-terminating slot assembly is essentially circular, so as to accommodate a needle bearing race in which one end of a cylindrical loaded roller element is captured for rotation about its longitudinal axis. A second end-terminating slot assembly provides for tangential translation of its associated unloaded roller element towards and away from the blade with which it is engaged, and has a first, generally rectangular cavity region. A first end of this cavity region is intersected by a pair of reduced width slots.

A slidable plug fits within and slides between first and second ends of the cavity region. This slidable block contains a circular needle bearing race in which one end of the unloaded roller element is captured for rotation about its longitudinal axis. A compression spring is captured within one of the reduced width slots of the cavity and serves to bias the slidable plug toward the blade in parallel with the action of the compression spring in the channel of the unloaded slot assembly of the spreader element, and thereby provide a continuous restoring force to ensure that the unloaded roller element maintains intimate contact with the blade.

In addition to allowing for mutual translation between the blade and the roller element on the unloaded side of the blade, the sealing arrangement is configured to accommodate pivoting of the blade about an axis that passes through the blade and extends in the radial direction from the inner hub to the interior surface of the housing. Such pivoting of the blade about its center line may result from a slight amount of play or offset between the elements of the parallel outer hub ring members at which the roller elements are end-terminated. In order to ensure proper sealing of the working gas compartments, it is necessary that the contact surface between each roller element and its associated blade have no gaps along the entire length of the roller element between the outer hub ring members. The pivotal connection of the blade to the inner hub effectively maintains this intended roller element—blade surface parallelism.

A second embodiment of the sealing arrangement of the present invention employs spring loaded sealing elements on both ends of the spreader elements and thereby on the sides of the roller elements which are not in contact with the respective blade. In this embodiment, each spreader has a slot assembly at the base of root of the cylindrical bores of the spreader element that capture or contain the roller elements. Low friction sealing elements fit within the slots and are biased against the roller elements by respective compression springs. These sealing elements serve to further reduce the quantity of high pressure working fluid gases that are allowed to escape from the cavities on the outside of the outer hub assemblies to the interior side of the outer hub assemblies.

BRIEF DESCRIPTION OF THE DRAWINGS

FIG. 7 being taken along lines 7—7 of FIG. 8, and FIG. 8 being taken along lines 8—8FIG. 4.

DETAILED DESCRIPTION

As pointed out briefly above, the blade sealing arrangement according to the present invention is configured so as to allow each of the roller elements on either side of the blade to rotate about its own axis, while permitting one of the roller elements (the unloaded roller element) to translate generally tangentially to the circular path described by the outer hub assembly. For this purpose, FIG. 4 diagrammatically illustrates a portion of the expander section of a continuous combustion, pinned vane type, positive displacement, rotary compressor and expander engine system, described above, in which each of the spreader elements of the expander's outer hub assembly is modified to allow one the roller elements, the ends of which are captured in slots in the outer hub ring members, to be translatable relative to the surface of the blade engaged by that roller element.

Figure 1:
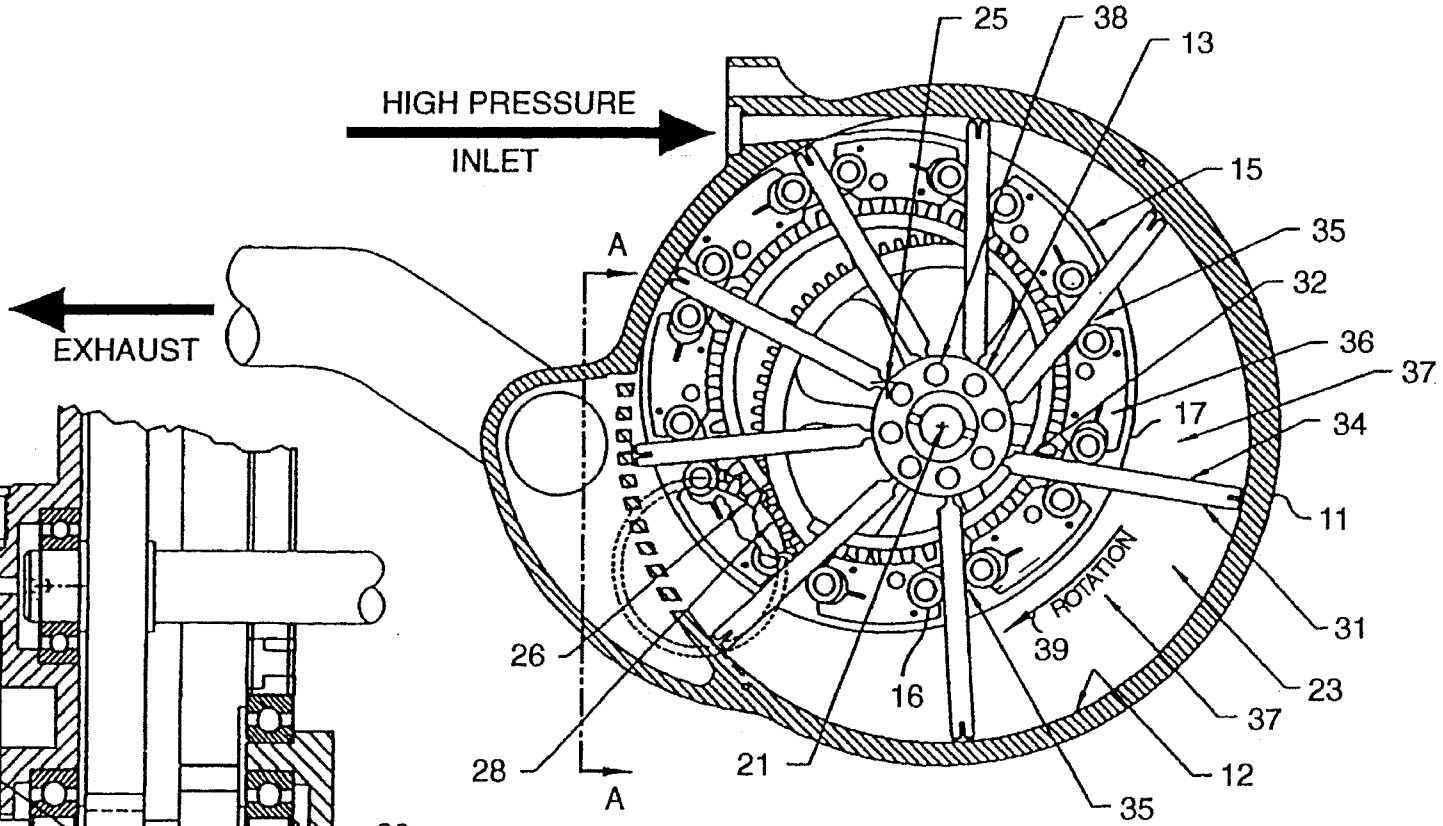
FIG. 1 diagrammatically illustrates the configuration of a continuous combustion, positive displacement, pinned vane compressor and expander heat engine system, of the type described in each of the above-referenced applications.
Figure 1A:
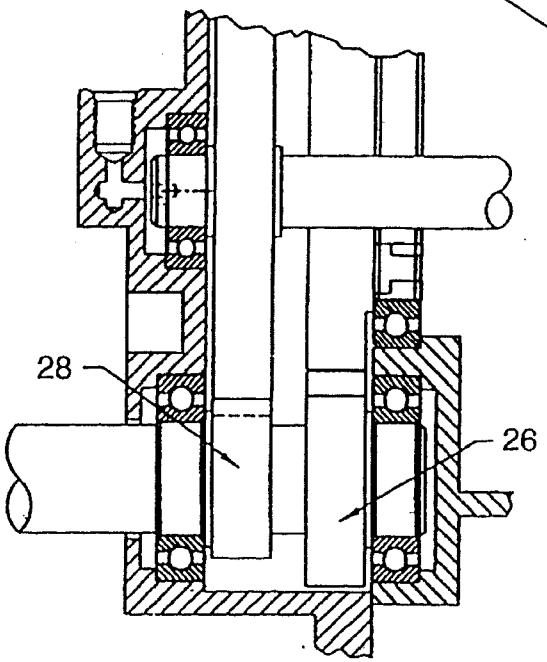
FIG. 1A shows an end sectional view of the timing gear arrangement employed in the engine system of FIG. 1.
Figure 2:
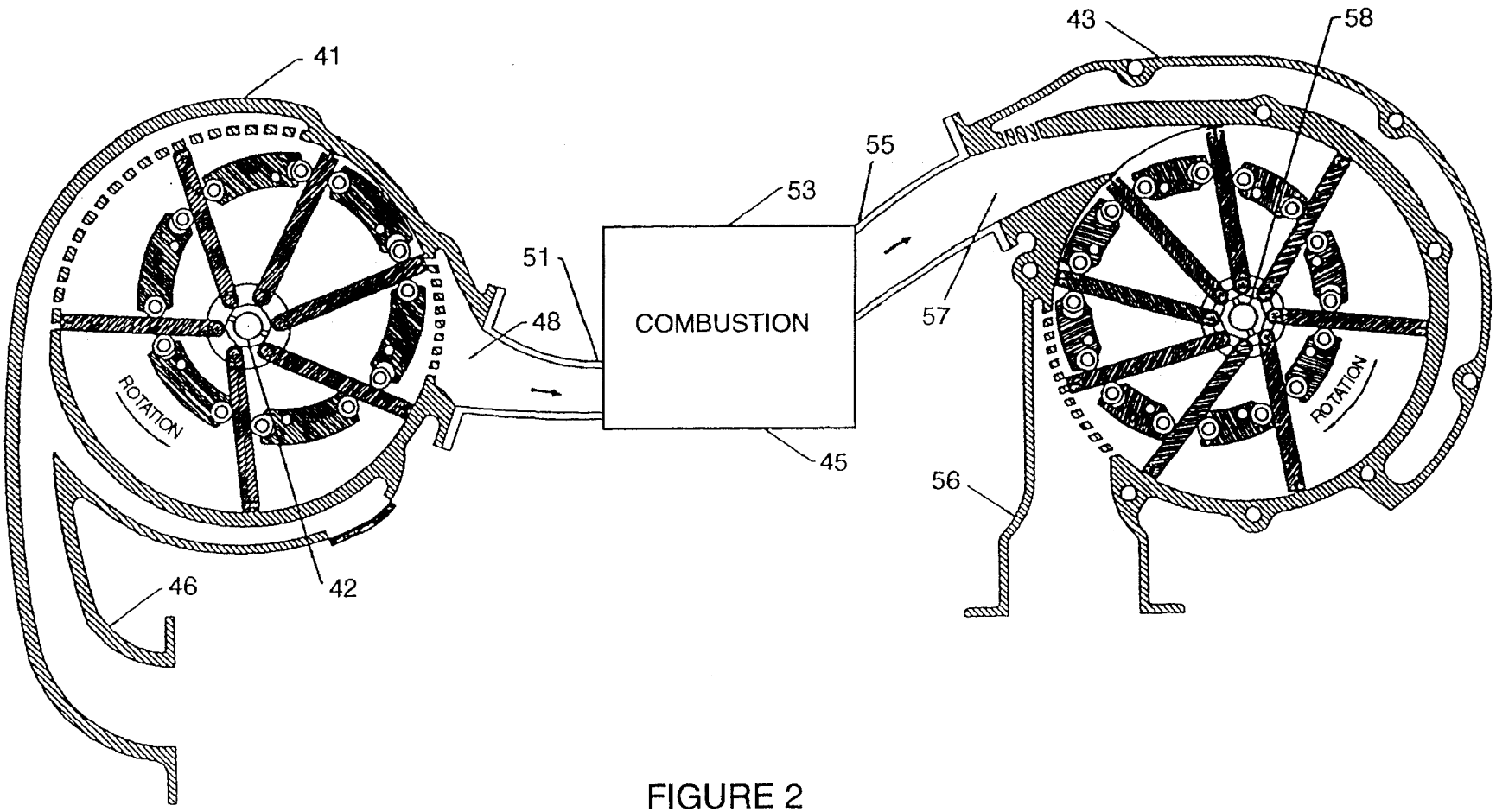
FIG. 2 diagrammatically illustrates a combined engine system, showing a compressor and an expander are employed in combination with a combustor.
Figure 3:
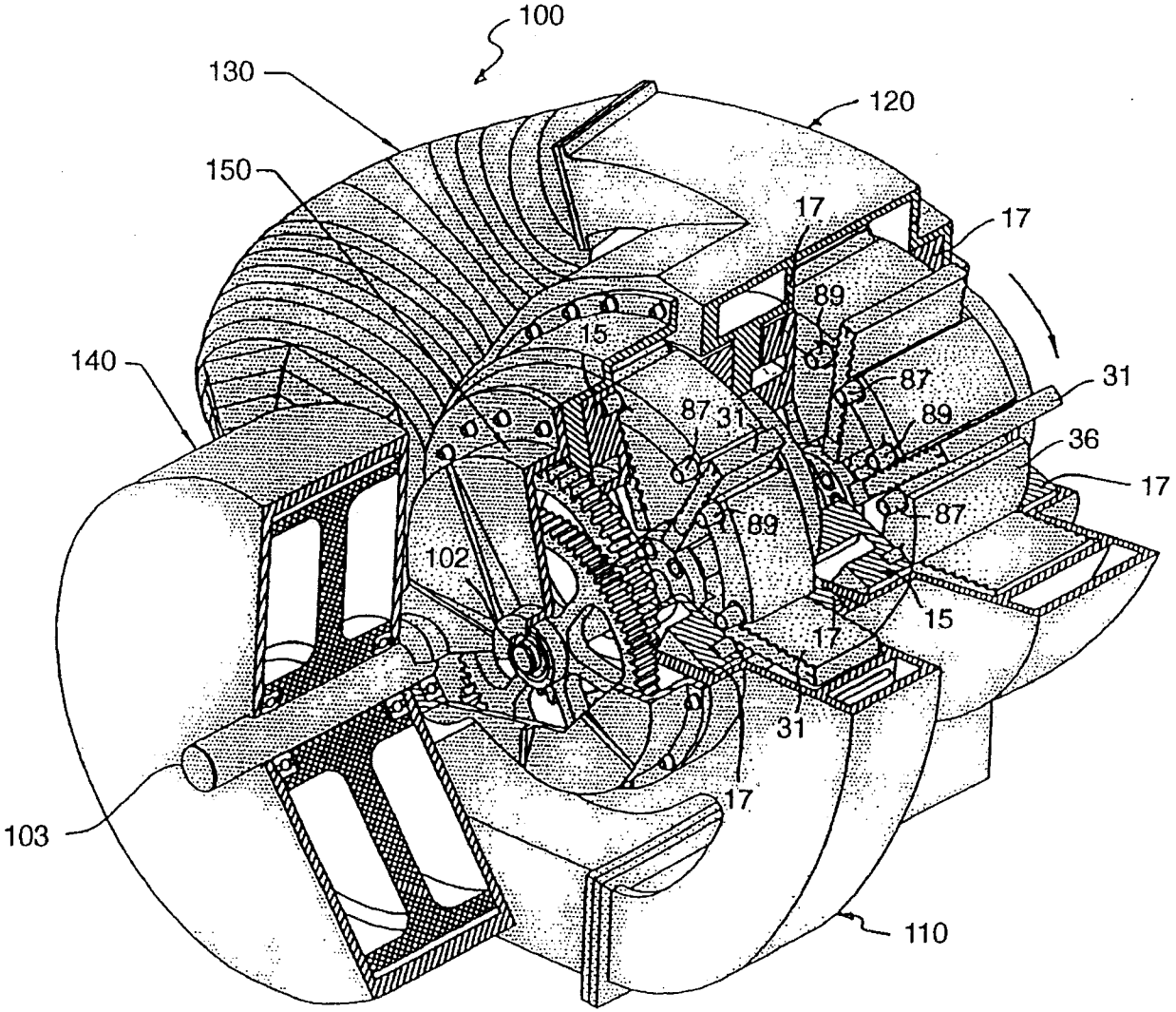
FIG. 3 is a partially cut-away perspective view of an integrated continuous combustion, positive displacement, pinned vane compressor and expander heat engine system.
Figure 4:
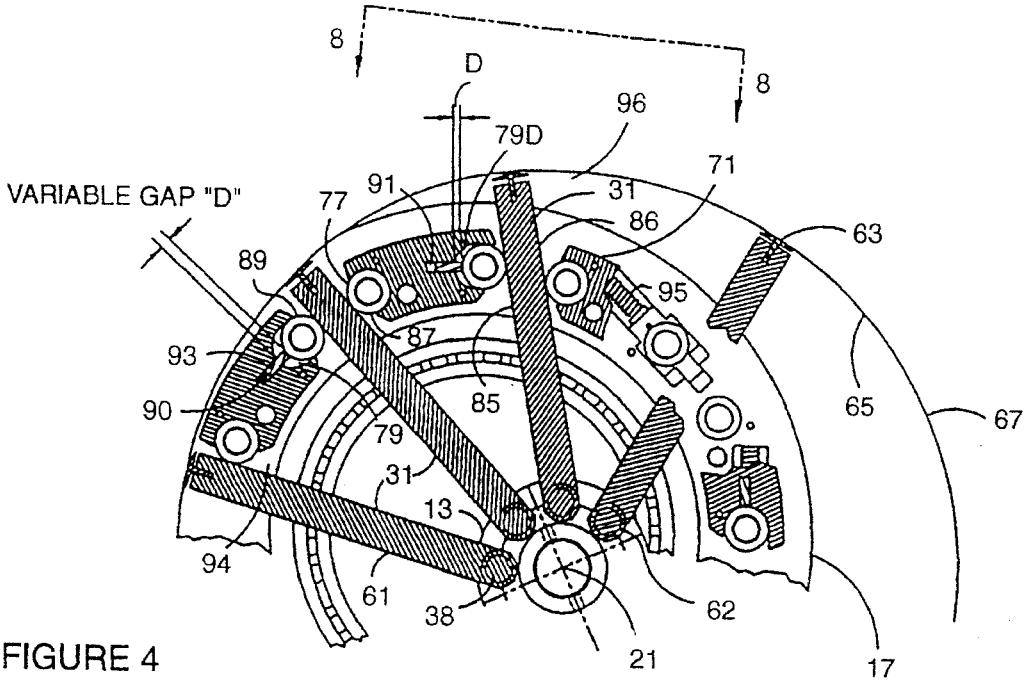
FIG. 4 diagrammatically illustrates a portion of the expander section of a continuous combustion, pinned vane type, positive displacement, rotary compressor and expander engine system, in which each of the spreader elements of the expander's outer hub assembly is modified to allow an unloaded sealing roller element to be translatable relative to the surface of the blade.

More particularly, FIG. 4 shows a number of spreader elements 71 of outer hub assembly, in which first ends 61 of a plurality of blades 31 are rotatably coupled to the inner hub 13, via pins 62, and have second ends 63 contacting the interior surface 65 of housing 67. First and second ends of each of the spreader elements 71 has respective slots assemblies 77 and 79. As will be described, each spreader element slot assembly is sized to receive generally cylindrically configured roller elements 87 and 89 so that the roller element may rotate freely about its longitudinal axis 83, 84. As will be described with reference to FIGS. 7 and 8, opposite ends of a respective roller element are captured in respective needle bearing races 80 of a pair of spaced apart outer hub assembly ring assemblies, between which blades 31 rotate.

Pursuant to the invention, in addition to being sized to provide for rotational motion engagement of a respective cylindrical roller element, one of the spreader element's two slot assemblies 77 and 79 (here, slot assembly 79 in the illustrated embodiment of FIG. 4) is shaped to allow for translation of its associated unloaded roller element 89 towards and away from the blade 31 with which it is engaged. Namely, slot assembly 79 of spreader element 71, rather than being precisely circular, conforming with the circular shape of the roller element 89, has an offset or deeper region 79D, that allows the roller element 89 to be captured by spreader element 71, but be tangentially translatable along the circular profile of the outer hub assembly. This ability to translate unloaded roller element 89 in the offset region 79D of slot assembly 79 provides a limited amount of play between roller element 89 and the fixed spreader element 71, so that as the inner hub 13, blades 31 and outer hub assemblies 15 rotate during an expansion working cycle, roller element 89 may shift within a variable gap or displacement distance D provided by offset region 79D relative to the engaged surface 85 of blade 31.

In order to maintain roller element 89 in sealed engagement with blade surface 85, slot assembly 79 further includes a channel 91, in which a blade spreader sealing element 93 is captured. The blade spreader sealing element 93 serves to prevent high pressure gases from passing behind the blade roller into the inner engine cavity 94. A blade roller-sealing element spring 95 is placed behind the blade roller sealing element 93 to keep the sealing element 98 biased against the roller element 89 regardless of the rotational position of the blade 31 about inner hub 13, thereby maintaining a relatively fluid-tight seal between the high pressure gases 96 and the inner engine cavity 94. Alignment pins 98 may also be used to maintain the relationship of the blade roller sealing element 93 to the roller element 89.

Figure 5:
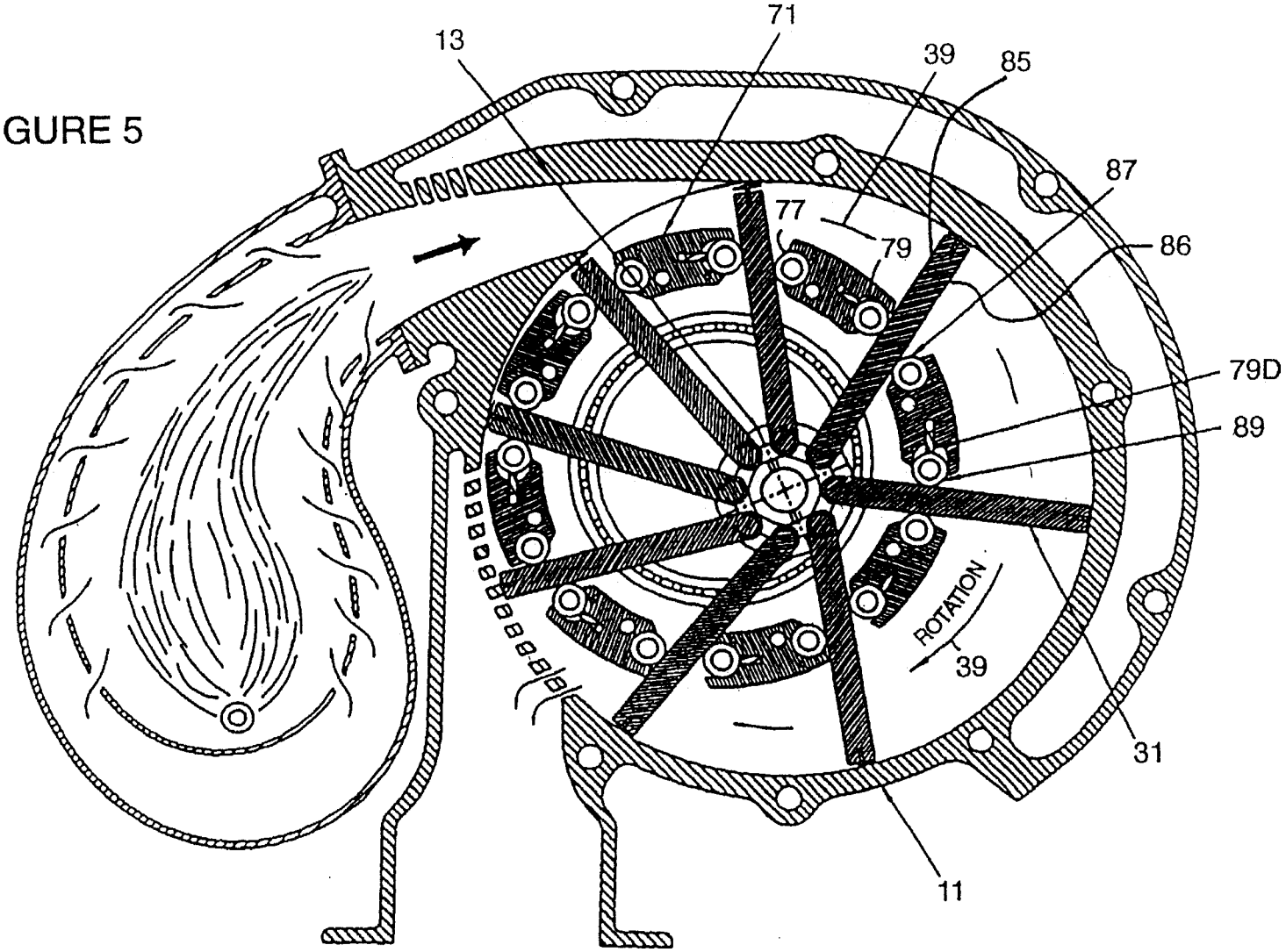
FIG. 5 diagrammatically illustrates an expander, in which unloaded slot assemblies are located on the unloaded, high pressure side of each blade, or upstream of the direction of travel, whereas loaded slot assemblies are located on the low pressure side of each blade, that drive the spreader elements of the outer hub assembly.

In the operation of the expander, diagrammatically illustrated in FIG. 5, where the expanding gas causes rotational movement of the blades, and the blades in turn drive the outer hub assembly, slot assemblies 79 are located on the unloaded, high pressure side of each blade, or upstream of the direction of travel (clockwise, as shown by arrow 39), whereas slot assemblies 77 are located on the low pressure side of each blade, that drive the spreader elements of the outer hub assembly. Namely, as blades 31 rotate, their downstream surfaces 86 are urged directly against or load roller elements 87 within slot assemblies 77. Since loaded roller element slot assemblies 77 do not provide for play or translation of their captured roller elements 87, the pressure of the expansion gas against each blade surface 85 is imparted directly through the blades and roller elements 87, translating the load to the roller bearings captured in the hub ring members of the outer hub assembly 15, causing the outer hub assembly 15 to rotate in the direction of working gas expansion. At the same time, since the unloaded roller elements 89, that are captured in deeper slot assemblies 79, are biased by compression springs 95 (FIG. 7) slidable blocks 111 in the cavities 101 of the ring assemblies 17, so as to be urged against blade surfaces 85, roller elements 89 are maintained in continuous sealing engagement with blade surfaces 85, as described above.

Figure 6:
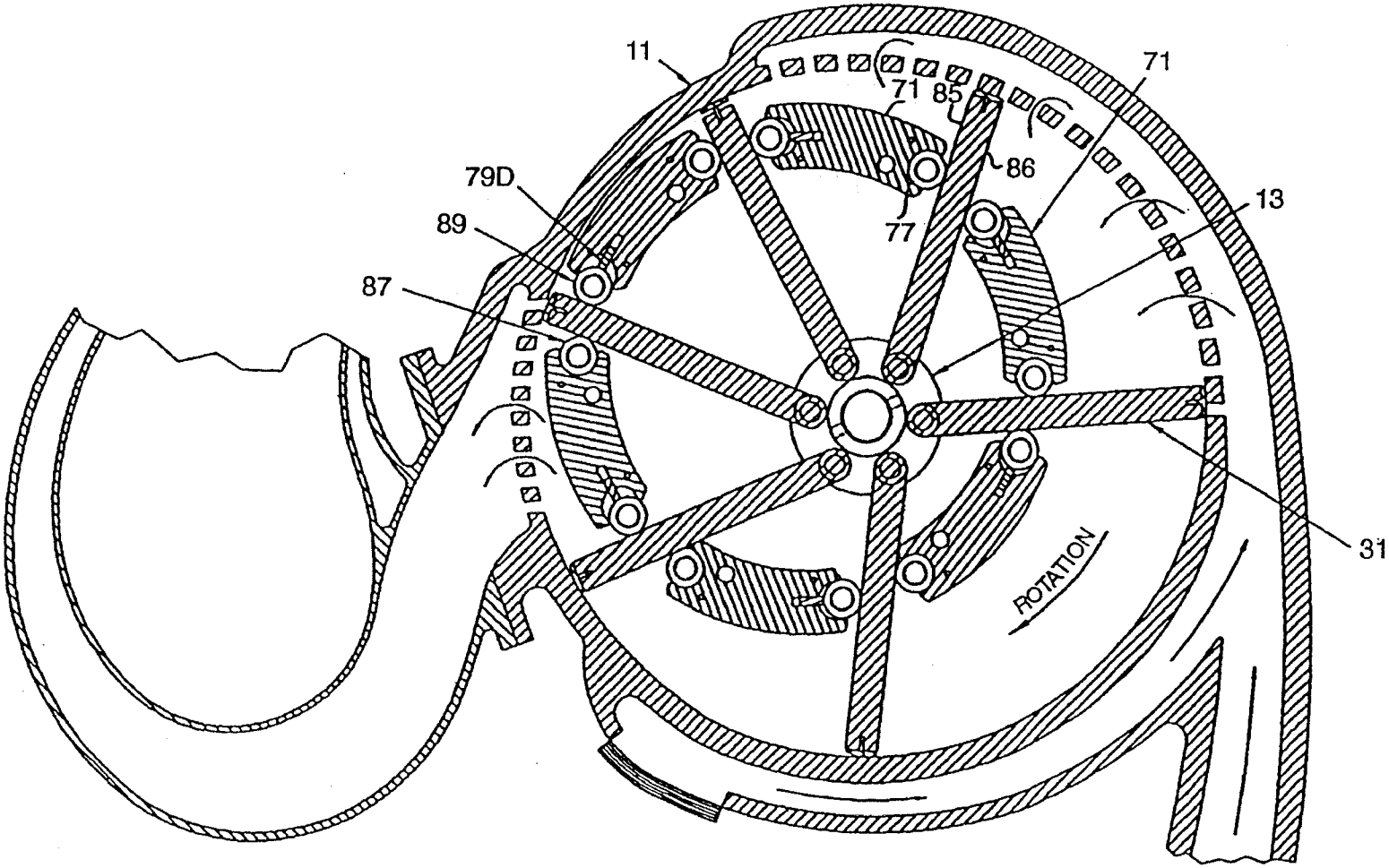
FIG. 6 diagrammatically illustrates a compressor, where unloaded slot assemblies are located on the unloaded side of each blade.

Conversely, in the operation of the compressor, shown diagrammatically in FIG. 6, where driving of the outer hub assembly 15, rotation of its roller elements 87 causes rotational movement of the blades 31. In the compressor configuration, slot assemblies 79 are located on the unloaded side 86 of each blade 31,. downstream of the direction of travel (clockwise), whereas slot assemblies 77 are located on the upstream or loaded side 85 of each blade 31. As the outer hub assembly 15 is driven by its drive shaft (in the clockwise direction), the roller elements which are end-terminate in needle bearings in the outer hub assembly causes to be urged directly against or load the upstream surfaces 85 of blades 31, causing the blades 31 to rotate and thereby compress the gas in the working fluid compartments. On the other hand, since slot assemblies 79 provide for play or translation of their captured roller elements 89 on the downstream or unloaded surfaces 86 of blades 31, compression springs 95 captured in cavities 101 bias slidable blocks 111 (FIG. 7) to maintain roller elements 89 in continuous sealing engagement with blade surfaces 86.

Figure 7:
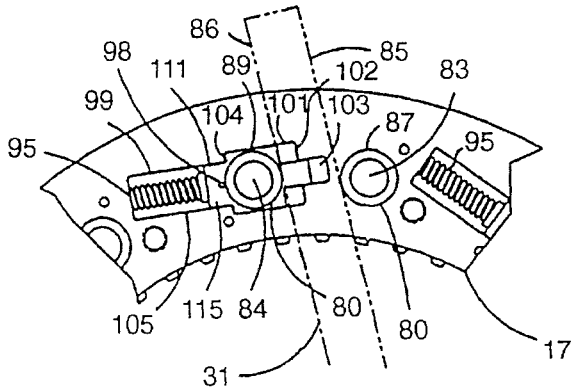
FIGS. 7 and 8 are respective partial side and top views of the manner in which roller elements are end-terminated in parallel, spaced apart ring members of the outer hub assembly.
Figure 8:
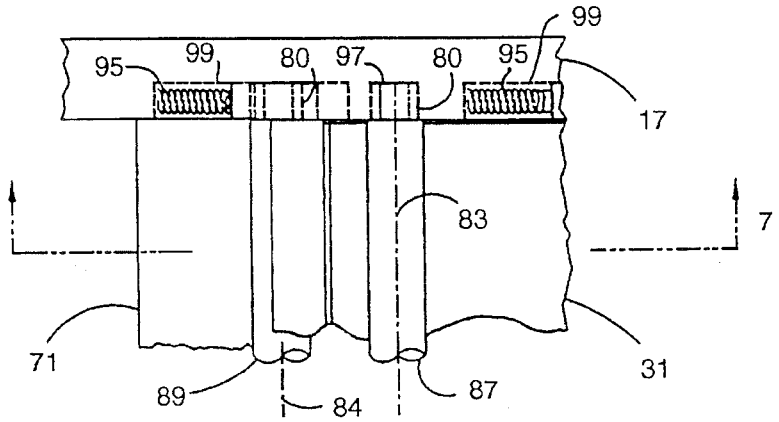

A detailed illustration of the manner in which the roller elements 87 and 89 are end-terminated in parallel, spaced apart ring members 17 of the outer hub assembly 15 is shown in the partial side and top views of FIGS. 7 and 8. Specifically, a first end-terminating slot assembly 97 is essentially circular, so as to accommodate a circular needle bearing race 80 in which one end of a cylindrical roller element 87 is captured for rotation about its longitudinal axis 83. A second end-terminating slot assembly 99, which provides for translation of its associated roller element 89 towards and away from the blade 31 with which it is engaged, is shown as having a first, generally rectangular cavity region 101, a first end 102 of which is intersected by a first, reduced width rectangular slot 103, and a second end 104 of which is intersected by a second, reduced width rectangular slot 105.

A slidable plug or block 111 having a generally rectangular central block portion 113 is sized to fit within and slide or translate between first and second ends 102 and 104 of cavity region 101. This central block portion 113 of block 111 contains a circular needle bearing race 80 in which one end of a cylindrical roller element 89 is captured for rotation about its longitudinal axis 84. Block 111 has a reduced width portion 115 which is sized to fit within slot 105. Compression spring 95 is captured within slot 105 and serves to bias slidable block 111 toward slot 103, thereby providing a continuous restoring force to ensure that the translational roller element 89 maintains intimate contact with the high pressure (unloaded) side of the blade. This configuration is repeated on each side of the blade 31 to maintain a uniform force on the roller element 89.

As pointed out above, in addition to allowing for mutual translation between the blade and the roller elements on either side of the blade as the blade rotates about it pinned axis at the inner hub, the sealing arrangement according to the present invention is also configured to accommodate pivoting of the blade about an axis that passes through the blade in the radial direction from the inner hub to the interior surface of the housing. Such pivoting of the blade results from the geometries created by the pinned location of the blade 31 at the inner hub 13 and the relationship to the loaded roller 87 of the outer hub ring assemblies as a function of rotative position of the mutual assemblies.

Figure 9:
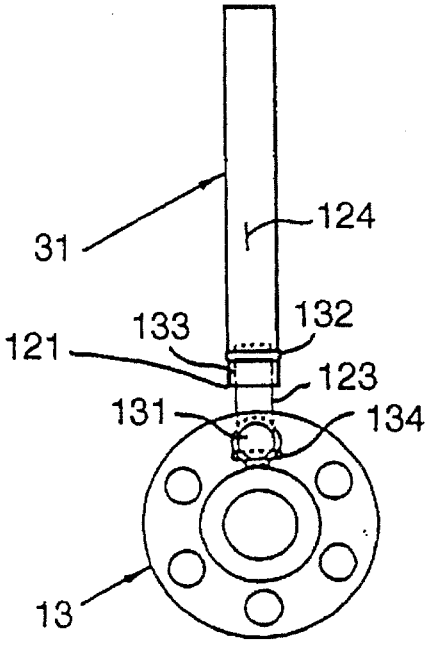
FIGS. 9 and 10 show respective side and end views of a pivotal blade —to— inner hub attachment.
Figure 10:
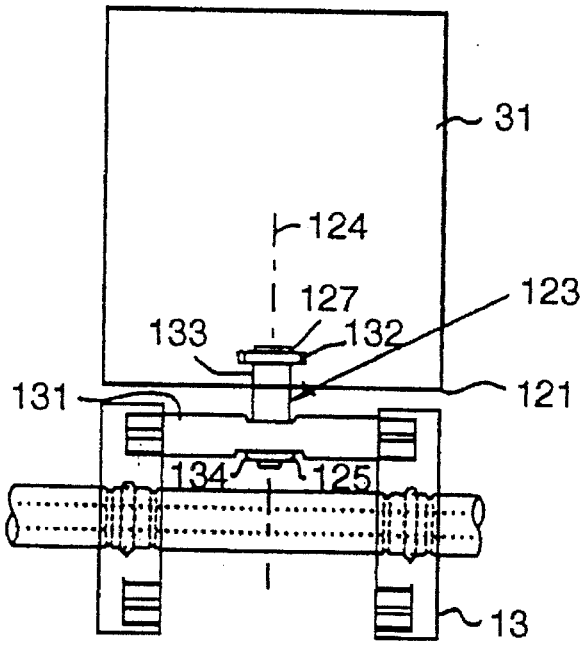

In order to ensure proper sealing of the working gas compartments and uniform loading of roller 87, it is necessary that the contact surface between each roller element 16 and its associated blade 31 have no gaps across the surface of the blade between outer hub assemblies. This problem is circumvented in accordance with the present invention by providing the pivotal blade to inner hub attachment shown in FIGS. 9 and 10.

Specifically, rather than directly pin the interior end 121 of a respective blade 31 directly to the inner hub 13, a pivotal attachment is provided by way of a pivot pin 123 having an axis of rotation 124 that passes through the blade 31 in the radial direction of the blade. A first end 125 of pivot pin 123 is captured by shaft 131 of inner hub 13, and a second end 127 of pivot pin extends through a cylindrical bore 133 at the interior end 121 of blade 31. Pivot pin 123 may be secured by suitable ring clamps 132, 134 as shown. During rotation of a blade 31 about inner hub 13, pivot pin 123 allows the blade to rotate about axis 124, and thereby be maintained in intimate contact with the entire length of each of its sealing cylindrical roller elements 87. Roller element 89 will maintain contact via independent loading of the compression spring 95.

Figure 11:
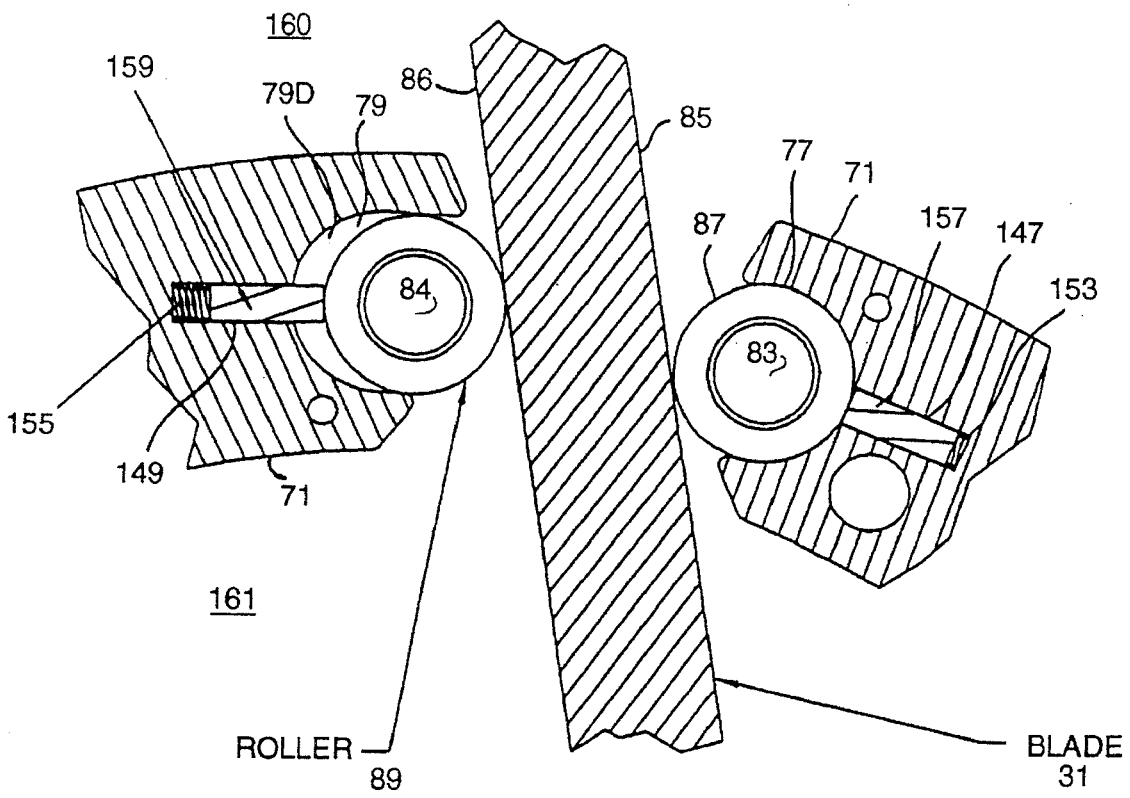
FIG. 11 diagrammatically illustrates a second embodiment of the sealing arrangement of the present invention, in which the spreader elements employ spring loaded sealing elements on both sides of a blade.

FIG. 11 diagrammatically illustrates a second embodiment of the sealing arrangement of the present invention, in which the spreader elements employ spring loaded sealing elements 159 and 157 on both sides of the blade 31. In this embodiment, first and second generally longitudinal bores or channels 147 and 149 extend from slots 77 and 79, respectively. Low friction elements 157 and 159 fit within bores 147 and 149 over the length of the spreader element 71 and are biased against roller elements 87 and 89 by respective compression springs 153 and 155. These sealing elements serve to further reduce the quantity of high pressure working fluid gases that are allowed to escape from the cavities on the outside of the outer hub assemblies 15 to the interior side of the outer hub assemblies. As in the first embodiment, slot 77 in which the loaded roller element 87 is captured is shaped and sized, so that the loaded roller element 87 does not translate in the tangential direction of movement of the outer hub assembly. It is merely augmented with the sealing channel 147 and associated sealing element 157. On the other hand, slot 79 in which the rear side roller element 89 is captured includes offset portion 79D, which is shaped and sized so that roller element 89 is permitted to translate in the tangential direction of movement of the outer hub assembly. Compression spring 155 maintains sealing element 159 urged against roller element 89; this bias action, in turn, maintains a relatively fluid-tight seal between the quantity of high pressure gases on the outside portion of the outer hub 160 and the interior portion of the engine system 161.

As will be appreciated from the foregoing description, the above described blade sealing requirement is successfully addressed in accordance with the present invention by allowing each of the roller elements on either side of the blade to rotate about its own axis and to allow one of the roller elements to translate along a path described by the outer hub assembly. In addition, the inventive sealing arrangement accommodates pivoting of the blade about an axis that passes through the blade in the radial direction from the inner hub to the interior surface of the housing, so that the contact surface between each roller element and its associated blade has no gaps across the surface of the blade between outer hub assemblies.

While I have shown and described several embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A pinned vane type, positive displacement, rotary device comprising:

a housing having a working fluid chamber surrounding a first axis and an inlet port through which a working fluid is introduced into said working fluid chamber;

an inner hub surrounding and rotatable about said first axis;

an outer hub assembly, having a plurality of spreader elements, disposed inside said chamber and surrounding said inner hub, said outer hub assembly being rotatable about a second axis, which is offset from said first axis;

a plurality of blades, each of which extends radially from said inner hub and passes through said spreader elements of said outer hub assembly to an interior surface of said chamber, thereby forming a plurality of relatively airtight compartments between said interior surface of said chamber, said spreader elements of said outer hub assembly, and respective pairs of blades, with the volume of said compartments varying as a function of rotative position about said first axis; and a linkage arrangement, which interconnects said inner hub with said outer hub exclusive of said blades; and wherein said outer hub assembly contains a ring member arrangement which supports a first, loaded roller element at a first side of said blade spreader element for rotation about a first longitudinal axis of said first roller element, and supports a second, unloaded roller element at a second side of said blade spreader element for rotation about a second longitudinal axis of said second roller element and which allows said second, unloaded roller element to translate generally tangentially with respect to a travel path described by said ring member arrangement of said outer hub assembly in accordance with the rotational position of said outer hub assembly about said second axis.

2. A pinned vane type, positive displacement, rotary device according to claim 1, wherein a respective blade spreader element includes a first sealing element which is supported in intimate fluid sealing contact with said first roller element, and a second sealing element which is supported in intimate fluid sealing contact with said second roller element, so as to minimize the passage of working fluid from the outer high pressure side of the outer hub assembly to a lower pressure internal portion of the outer hub assembly.

3. A pinned vane type, positive displacement, rotary device according to claim 1, wherein said blades are pivotally attached to said inner hub to allow rotation of a respective one of said blades relative to an axis extending radially through the center line of said blade from said inner hub.

4. A rotary device comprising:

a housing having an interior working fluid chamber surrounding a first axis and an inlet port into which a working fluid is introduced;

an outer hub assembly, disposed inside said chamber and surrounding a second axis, said second axis being offset from said first axis;

an inner hub, disposed inside said outer hub assembly, and surrounding said first axis;

a plurality of blades, each of which extends radially from said inner hub and passes through said outer hub assembly to an interior surface of said chamber, thereby forming a plurality of relatively airtight compartments between said interior surface of said chamber, said outer hub assembly, and respective pairs of blades, with the volume of said compartments varying as a function of rotative position about said first axis; and a linkage arrangement, which interconnects said inner hub with said outer hub exclusive of said blades; and wherein said outer hub assembly includes a pair of ring members arranged at opposite ends of said blades, each ring member supporting opposite ends of first, non load-bearing and second, load-bearing sealing roller elements of respective pairs of sealing roller elements on first and second sides of respective blades, and further including a plurality of blade spreader elements respectively disposed between respective pairs of sealing roller elements adjacent said blades, such that, irrespective of the rotational position of said outer hub assembly about said second axis, said first, non load-bearing sealing roller elements are translatable with respect to said ring members and are urged into sealing engagement with first sides of said blades, and such that said second, load-bearing sealing roller elements are urged in load-bearing engagement with second sides of said blades and said ring members.

5. A rotary device according to claim 4, wherein said ring members include first roller element-terminating bearings translatable along said ring members and arranged to receive opposite ends of said first, non load-bearing, translatable sealing roller elements, and second roller element-terminating bearings arranged to receive opposite ends of said second, load-bearing sealing roller elements.

6. A rotary device according to claim 5, wherein said first, translatable sealing roller element terminating bearings are spring-biased toward said first sides of said blades.

7. A rotary device according to claim 5, wherein said ring members of said outer hub assembly include sliding block elements in which said first, translatable sealing roller element terminating bearings are captured, said sliding block elements being spring-biased along said ring members toward engagement with said first sides of said blades.

8. A rotary device according to claim 4, wherein each of said blades is pivotally attached to said inner hub so as to allow rotation of said each of said blades about a respective axis extending radially of said inner hub.

9. A rotary device according to claim 8, wherein said radially extending axis passes through said each of said blades.

10. A rotary device according to claim 4, wherein a respective blade spreader element further comprises a first fluid sealing element which is supported in intimate sealing contact with a first, non load-bearing, translatable sealing roller element, so as to minimize the passage of working fluid from an outer portion of the hub assembly to an inner portion of said outer hub assembly.

11. A rotary device according to claim 10, wherein a respective blade spreader element comprises a first, translatable, non load-bearing sealing roller element-receiving slot which receives and allows rotation of a first, translatable, non load-bearing sealing roller element, and a first bore, coupled with said first, translatable, non load-bearing sealing roller element-receiving slot, and wherein said first sealing element is disposed in said first bore and maintained in intimate sealing contact with said first, translatable, non load-bearing sealing roller element.

12. A rotary device according to claim 11, wherein a respective blade spreader element further comprises a second, load-bearing sealing roller element-receiving slot, which receives and allows rotation of a second load-bearing sealing roller element, and a second bore, coupled with said second load-bearing sealing roller element-receiving slot, and wherein said second sealing element is disposed in said second bore and maintained in intimate sealing contact with said second load-bearing sealing roller element.

13. A rotary device according to claim 11, wherein said first bore contains a spring element for urging said first sealing element into intimate fluid-sealing contact with said first, translatable, non load-bearing sealing roller element.

14. A rotary device according to claim 12, wherein said first bore contains a first element for urging said first sealing element into intimate fluid-sealing contact with said first, translatable, non load-bearing sealing roller element, and wherein said second bore contains a second spring element for urging said second sealing element into intimate fluid-sealing contact with said second load-bearing sealing roller element.

15. A rotary device according to claim 10, wherein each of said blades is pivotally attached to said inner hub so as to allow rotation of said each of said blades about a respective axis extending radially of said inner hub.

16. A rotary device according to claim 15, wherein said radially extending axis passes through said each of said blades.

17. A rotary device comprising:

a housing having an interior working fluid chamber surrounding a first axis and an inlet port into which a working fluid is introduced;

an outer hub assembly, disposed inside said chamber and surrounding a second axis, said second axis being offset from said first axis;

an inner hub, disposed inside said outer hub assembly, and surrounding said first axis;

a plurality of blades, each of which extends radially from said inner hub and passes through said outer hub assembly to an interior surface of said chamber, thereby forming a plurality of relatively airtight compartments between said interior surface of said chamber, said outer hub assembly, and respective pairs of blades, with the volume of said compartments varying as a function of rotative position about said first axis, each of said blades being pivotally attached to said inner hub so as to allow rotation of said each of said blades about a respective axis extending radially of said inner hub; and a linkage arrangement, which interconnects said inner hub with said outer hub exclusive of said blades.

18. A rotary device according to claim 17, wherein said radially extending axis passes through said each of said blades.

* * * * *